US009833793B2

(12) United States Patent
Polinder et al.

(10) Patent No.: US 9,833,793 B2
(45) Date of Patent: Dec. 5, 2017

(54) MAGNET AND DEVICE FOR MAGNETIC DENSITY SEPARATION

(71) Applicant: Urban Mining Corp B.V., Rotterdam (NL)

(72) Inventors: Hendrik Polinder, Delft (NL); Peter Carlo Rem, Delft (NL)

(73) Assignee: Urban Mining Corp B.V., Rotterdam (NL)

( * ) Notice: Subject to any disclaimer, the term of this patent is extended or adjusted under 35 U.S.C. 154(b) by 0 days.

(21) Appl. No.: 14/780,179

(22) PCT Filed: Mar. 21, 2014

(86) PCT No.: PCT/NL2014/050177
§ 371 (c)(1),
(2) Date: Sep. 25, 2015

(87) PCT Pub. No.: WO2014/158016
PCT Pub. Date: Oct. 2, 2014

(65) Prior Publication Data

US 2016/0038949 A1 Feb. 11, 2016

(30) Foreign Application Priority Data

Mar. 25, 2013 (NL) ..... 2010515

(51) Int. Cl.
*B03C 1/00* (2006.01)
*B03C 1/32* (2006.01)
(Continued)

(52) U.S. Cl.
CPC ..... *B03C 1/32* (2013.01); *B03C 1/01* (2013.01); *B03C 1/0332* (2013.01);
(Continued)

(58) Field of Classification Search
CPC ..... B03C 1/01; B03C 1/0332; B03C 1/0335; B03C 1/288; B03C 1/32; B03C 2201/20
(Continued)

(56) References Cited

U.S. PATENT DOCUMENTS 5,420,556 A * 5/1995 Okazaki ..... H01F 7/0284 335/210
2004/0004523 A1 1/2004 Humphries et al.
2011/0042274 A1* 2/2011 Rem ..... B03C 1/01 209/3

FOREIGN PATENT DOCUMENTS

EP 1 800 753 6/2007
GB 2 278 231 11/1994
WO WO 2009/108047 9/2009

OTHER PUBLICATIONS

International Search Report dated May 14, 2014 for Appln. No. PCT/NL2014/050177.
(Continued)

*Primary Examiner* — Joseph C Rodriguez
*Assistant Examiner* — Kalyanavenkateshware Kumar
(74) *Attorney, Agent, or Firm* — Pillsbury Winthrop Shaw Pittmann, LLP

(57) ABSTRACT

A planar magnet for magnetic density separation, comprising an array of pole pieces succeeding in longitudinal direction of a mounting plane, each pole piece having a body extending transversely along the mounting plane with a substantially constant cross section that includes a top segment that is curved to distribute the magnetic field associated with the top surface of the pole piece such that its strength transverse to the mounting plane is substantially uniformly distributed in planes parallel to the mounting plane, the curved top segments having a width (w) in longitudinal direction of the mounting plane and a maximum height (h) transverse to the mounting plane, wherein the top
(Continued)

segments of successive pole pieces are unequal in height and/or width.

12 Claims, 3 Drawing Sheets

(51) Int. Cl.
*B03C 1/01* (2006.01)
*B03C 1/033* (2006.01)
*B03C 1/28* (2006.01)
*H01F 7/02* (2006.01)

(52) U.S. Cl.
CPC ..... *B03C 1/0335* (2013.01); *B03C 1/288* (2013.01); *H01F 7/0231* (2013.01); *B03C 2201/20* (2013.01); *H01F 7/0278* (2013.01)

(58) Field of Classification Search
USPC ..... 209/38, 636, 213, 223.1
See application file for complete search history.

(56) References Cited

OTHER PUBLICATIONS

Lahaye et al., "Magnet designs for magnetic density separation of polymers", International conference on solid waste technology and management: ICSW; The 25$^{th}$ conference on solid waste, technology and management, Philadelphia, PA, Jan. 1, 2011, pp. 977-983.
European Examination Report dated Oct. 21, 2016 for Appln. No, 14715712.7.
Dang Manh Nguyen: "Isogeometric analysis and shape optimization in electromagnetism", Feb. 28, 2012, XP055309775, Retrieved from the Internet: URL:http://orbit.dtu.dk/files/6632252/prod11329314112086.Nguyen_Dang_Manh_PhD_thesis_MAT[1].pdf.

* cited by examiner

MAGNET AND DEVICE FOR MAGNETIC DENSITY SEPARATION

This application is the National Phase of PCT/NL2014/050177, filed Mar. 21, 2014, which claims priority to Netherlands Application No. 2010515, filed Mar. 25, 2013, the entire contents of both applications being incorporated herein by reference in their entireties.

The invention relates to a magnet and a device for magnetic density separation (MDS).

Density separation is used in raw materials processing for the classification of mixed streams into streams with particles of different types of materials. In an accurate form of density separation, a liquid medium is used in which the lighter material float and the heavier materials sink. The process requires a liquid medium that has a density that is intermediate between the density of the light and heavy materials in the feed, yet is inexpensive and safe. In magnetic density separation this is provided using a magnetic liquid. The magnetic liquid has a material density which is comparable to that of water. However, when a gradient magnetic field is applied to the magnetic liquid, the force on a volume of the liquid is the sum of gravity and the magnetic force. In this way, it is possible to make the liquid artificially light or heavy, resulting in a so called cut density. For magnetic density separation, use is made of a large planar magnet. The field decays with the height above the magnet, preferably exponentially with the height above the magnet surface. EP 1 800 753 and WO 2009/108047 disclose a method and apparatus for magnetic density separation.

For accurate separation on density in a magnetic liquid preferably a magnet is used that, within the volume of magnetic liquid above the magnet, creates a field with a substantially constant intensity in each plane parallel to the magnet. The result is that magnetic forces on the liquid are essentially perpendicular to these planes, and depend essentially only on the coordinate perpendicular to the plane.

The magnet proposed in EP 1 800 753 requires a relatively large amount of complex-shaped permanent magnetic material, which is expensive. In an attempt to economize on material, an improved magnet for magnetic density separation has been proposed in "Magnet designs for magnetic density separation of polymers', The 25$^{th}$ conference on solid waste, technology and management, Mar. 27-30, 2011, Philadelphia, Pa., USA, The journal of solid waste technology and management, ISSN 1091-8043 (2011) 977-983.

In this publication, a planar magnet according to the preamble of claim is proposed, which includes a flat steel support, onto which a series of poles is mounted. The poles are alternately made from steel and from a magnetic material, and have a specially shaped cap made from steel. A gap filled with air or non-magnetic compound such as a polymer resin separates consecutive poles.

Although successful in its efficient construction, in contrast to what was expected, the field of the magnet did not have substantially constant intensity in the respective parallel planes.

The invention aims to provide a planar magnet for magnetic density separation which is of cost effective construction, yet maintains a field of substantially constant intensity in each plane parallel to the magnet.

Thereto the invention provides for a planar magnet for magnetic density separation, comprising an array of pole pieces succeeding in longitudinal direction of a mounting plane, each pole piece having a body extending transversely along the mounting plane with a substantially constant cross section that includes a top segment that is curved to distribute the magnetic field associated with the top surface of the pole piece such that its strength transverse to the mounting plane is substantially uniformly distributed in planes parallel to the mounting plane, the curved top segments having a length (l) in transverse direction of the mounting plane, a width (x) in longitudinal direction of the mounting plane and a height (h) transverse to the mounting plane, characterized in that the top segments of successive pole pieces are unequal in length (l), height h) and/or width (x).

Within this context, the term unequal in length, height or width is to be understood as a respective length, height or width of a pole that is neither the same nor a natural integer multiple of a successive pole.

Arranging the top segments of successive poles to be curved in accordance to the same function of shape, yet to extend over a different length, width and/or be positioned at different heights, differences in the intensity of the magnetic fields of the successive poles can be compensated for, while maintaining the uniform characteristics of the individual fields. It has been found, that a shift in height of the top portion does not require a different shape of the top portion to generate the uniform field distribution in planes parallel to the magnet. Alternatively or in addition, a difference in length and or width of the top segment may also be used for field correction if the top segments of the poles are provided with the same basic curvature.

In longitudinal direction of the mounting plane, each successive pole piece in longitudinal direction in the array of pole pieces may be unequal in height, length and/or width to its predecessor, or only a part of the total number of poles pieces in longitudinal direction in the array may be unequal in height, length and/or width to its predecessor, e.g. a subgroup of two, three or more successive pole pieces. The poles pieces at odd and/or even positions may be identical, and the leading and/or trailing pole pieces may be of smaller width than the interposed pole pieces.

To facilitate construction, the mounting plane may be a support plate onto which the pole pieces are mounted. Preferably, the support plate is made of a magnetisable material, in particular ferromagnetic material, in particular steel. As an alternative, the pole pieces may be mounted individually or in smaller groups onto a support.

By having the pole pieces extend parallel in transverse direction of the mounting plane uniform distribution of the field in transverse direction of the field may be achieved relatively easily. As an alternative, the magnetic permeability of the gaps between successive pole pieces may be changed to compensate for an alignment of pole pieces.

To reduce the number of pole pieces further, the successive poles may be spaced apart in longitudinal direction of the mounting plane. Gaps between the successive poles may be filled with magnetically permeable filler material, for example air, non magnetisable metal and/or polymer resin.

To save costs of construction, in longitudinal direction of the mounting plane, the pole pieces may alternatingly be embodied as magnets and magnetisable poles. The magnets may e.g. be permanent magnets, such as neodymium magnets, or electro-magnets. The magnetisable poles may be made of a magnetisable material, preferably a ferromagnetic material, in particular steel. In such arrangement, successive pole pieces that are embodied as magnets may be of the same polarity, in particular in a north to south or south to north configuration transverse to the mounting plane.

To save costs on construction, the magnets may include a magnetic base portion and a separate top portion of magnetisable material that includes the curve top segment. For example, the magnet pole may include a base portion that is rectangular in cross section onto which a steel top portion is placed which is machined to have a curved top.

Seen in longitudinal direction, the pole pieces at the leading end and/or trailing end of the mounting plane may be magnetic pole pieces.

Seen in longitudinal direction, the pole pieces at the leading end and/or trailing end of the mounting plane may have a width that is be more than half the width of any of the interposed pole pieces. The width may, however be less than the width of any of the interposed pole pieces.

The invention also relates to a magnetic density separation device including a planar magnet.

The invention will be further elucidated on the basis of a non-limitative exemplary embodiment which is represented in a drawing. In the drawing.

It is noted that the figures are merely schematic representations of a preferred embodiment of the invention. In the figures, identical or corresponding parts are represented with the same reference numerals.

Figure 1:
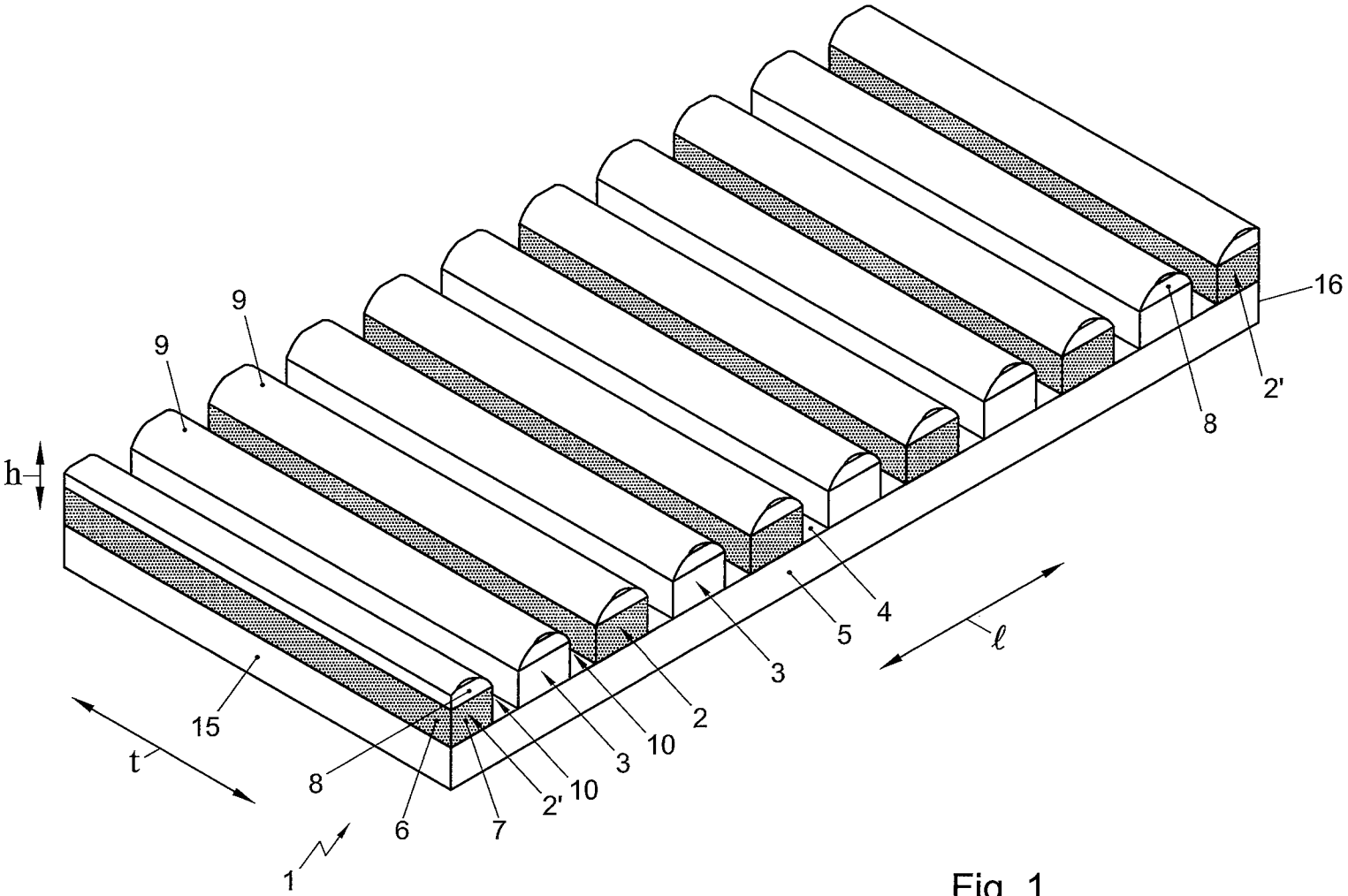
FIG. 1 shows a schematic exploded view of a planar magnet for magnetic density separation.
Figure 2:
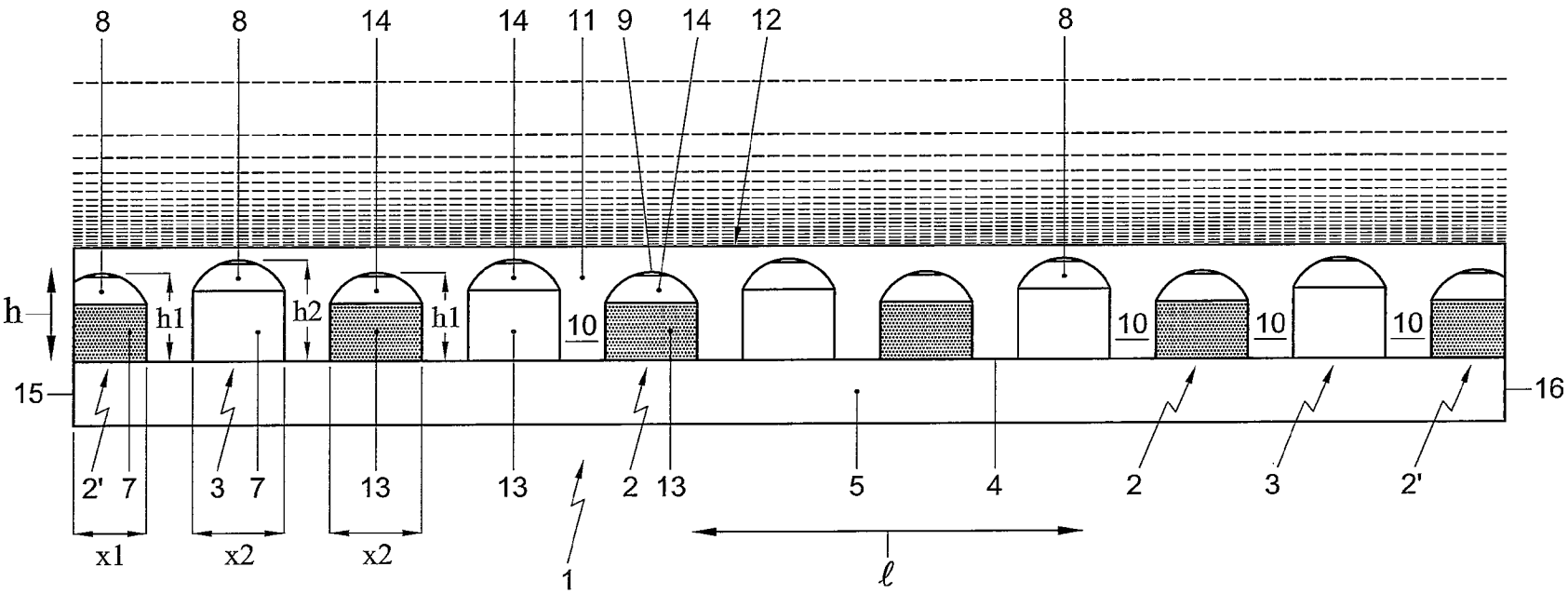
FIG. 2 shows a schematic side view of a detail of the array of pole pieces of the planar magnet of FIG. 1, in which the difference in height and or width of the pole pieces has been drawn exaggeratedly to increase visibility.

FIG. 1 shows a planar magnet 1 for magnetic density separation. The magnet 1 comprises an array of pole pieces 2, 3 succeeding in longitudinal direction l of a mounting plane 4. In the embodiment shown, the mounting plane 4 is a thick steel support plate 5 onto which the pole pieces 2, 3 are mounted. Each pole piece 2, 3 has a body 6 extending in transverse direction t along the mounting plane 4. Each body 6 extends transversely along the mounting plane 4 with a substantially constant cross section 7. In the embodiment shown, the pole pieces 2, 3 extend parallel in transverse direction t of the mounting plane 4. The cross section 7 of the body 6 of each pole piece 2, 3 includes a top segment 8 that is curved to distribute a magnetic field associated with the top surface 9 such that its strength transverse to the mounting plane is substantially uniformly distributed in planes parallel to the mounting plane 4. This is illustrated in FIG. 2.

The top segments of the pole pieces in the array are provided with the same basic curvature.

As set out in the publication "Magnet designs for magnetic density separation of polymers, The 25$^{th}$ International conference on solid waste, technology and management, Mar. 27-30, 2011, Philadelphia, Pa., USA, The journal of solid waste technology and management, ISSN 1091-8043 (2011) 977-983", in particular pages 979-981 the curvature of the top surface may be mathematically represented by the following formula:

$$z = \frac{p}{\pi}\ln\sin\left(\frac{\pi x}{p}\right)$$

In this formula, z is de height of points at the top surface with respect to a fixed reference point (the highest point) of the top surface, as a function of the horizontal coordinate x, $0<x<p$ , running along the cross-section of the magnet as in FIGS. 1 and 2. The parameter p is the interval in x over which the profile is periodic.

As can be taken from FIG. 2, the curved top segments 8 have a width x in longitudinal direction l of the mounting plane 4 and a maximum height h transverse to the mounting plane 4.

In accordance with the invention, the top segments 8 of successive pole pieces in longitudinal direction l are unequal in height h and/or width x. In the embodiment shown, in longitudinal direction l of the mounting plane 4, each successive pole piece 2,3 in the array of pole pieces is unequal in height h or width x to its predecessor. The leading and trailing pole pieces 2' at the respective leading end 15 and trailing end 16 of the magnet 1 are of smaller width x1 than the width x2 of the pole pieces 2, 3 interposed between the leading and trailing pole pieces 2'. The width xl of the leading and trailing pole pieces 2' can e.g. be 60 mm, while the width x2 of the interposed pole pieces 2, 3 of the interposed pole pieces can e.g. be 80 mm. The leading and trailing pole pieces 2' are magnetisable pole pieces. Their width x1 is however larger than half the width x2 of the interposed magnetisable pole pieces 2. This allows to reduce loss of laterally extending magnetic flux at the leading and trailing end of the support plate 5.

In the embodiment shown, the interposed pole pieces 2, 3 are embodied as magnets 2 at odd pole positions, and as magnetisable pole pieces 3 at even positions. The interposed magnetisable pole pieces 3 have a top surface 9 that is identical in shape to the top surface 9 of the interposed magnetic pole pieces 2, and the width x of these pieces is identical, but the position of their top surfaces 9 is shifted vertically upward in the same orientation so that the height h2 of the magnetisable pole pieces 3 is higher than the height h1 of the magnetic pole pieces 2. In practice, the height h1 can e.g. be 60 mm, the height h2 can be e.g. 80 mm.

This allows the magnetisable pole pieces 2 to have more volume of material, so that the weaker field strength of the magnetisable material compared to the magnetic material can be compensated for, yet the distribution of the field lines over the top surface is still such that it creates a field with a substantially constant intensity in each plane parallel to the pole piece and, due to the compensation, for the whole planar magnet.

The length (l) of the top segments 8 of the pole pieces 2, 3 transverse to the longitudinal direction is in this embodiment the same for all pole pieces, but may also be varied to compensate. In particular, the leading and/or trailing pole pieces may be provided with a greater length (l).

As can be taken from FIG. 2, in this exemplary embodiment, successive pole pieces that are embodied as magnets 2 are of the same polarity. In particular, the north-south orientation of these pole pieces 2 is aligned and transverse to the mounting plane 4.

With reference to FIGS. 1 and 2, it is shown that successive poles 2, 3 may be spaced apart in longitudinal direction l of the mounting plane 4. Gaps 10 between successive poles are in this example filled with magnetically permeable filler material, in this example polyester resin 11. This prevents clogging of the gaps 10 with foreign material. The resin 11 also extends over the tops of the pole pieces 2, 3 to provide a smooth surface 12 of the magnet 1. The gaps are filled with magnetically permeable filler material.

In longitudinal direction of the mounting plane 4, the pole pieces 2, 3 are alternatingly embodied as magnets 2 and magnetisable poles 3. In the embodiment shown, the pole pieces with reference numeral 2 are embodied as neodymium magnets, and the pole pieces provided with reference numeral 3 are embodied as steel magnetisable pole pieces. For ease of manufacture, the magnets 2 include a magnetic base portion 13 with a rectangular cross section, and a top portion 14 of steel that has been machined to include the curved top surface 9.

In accordance with the invention, the top segments 8 of successive pole pieces 2,3 are unsymmetrical in a mirror plane normal to the mounting plane and extending in transverse direction trough the center of the gap 10 between successive magnets: the height positions of the successive interposed top segments is not equal, and the width of the pole pieces at the ends is not such that the successive poles each other's whole or half image.

As an example, in Table 1 below, measurements are provided of the extremes of the magnetic field along the x-axis of a magnet (p=0.12 m) designed with a corrective widening of the magnet poles at the upper and lower edges. It is shown that the corrective widening improves the field homogeneity with respect to the uncorrected version in the sense that the differences between the extremes is now everywhere less than 0.05 Tesla. Especially near the leading or trailing end where the separation of the products takes place and the field homogeneity is most important, the differences are even smaller.

TABLE 1

| X [mm] | Bz [Tesla] |
|---|---|
| −600 | 0.22 |
| −480 | −0.20 |
| −360 | 0.25 |
| −240 | −0.20 |
| −120 | 0.25 |
| 0 | −0.20 |
| +120 | 0.25 |
| +240 | −0.20 |
| +360 | 0.25 |
| +480 | −0.20 |
| +600 | 0.22 |

Figure 3:
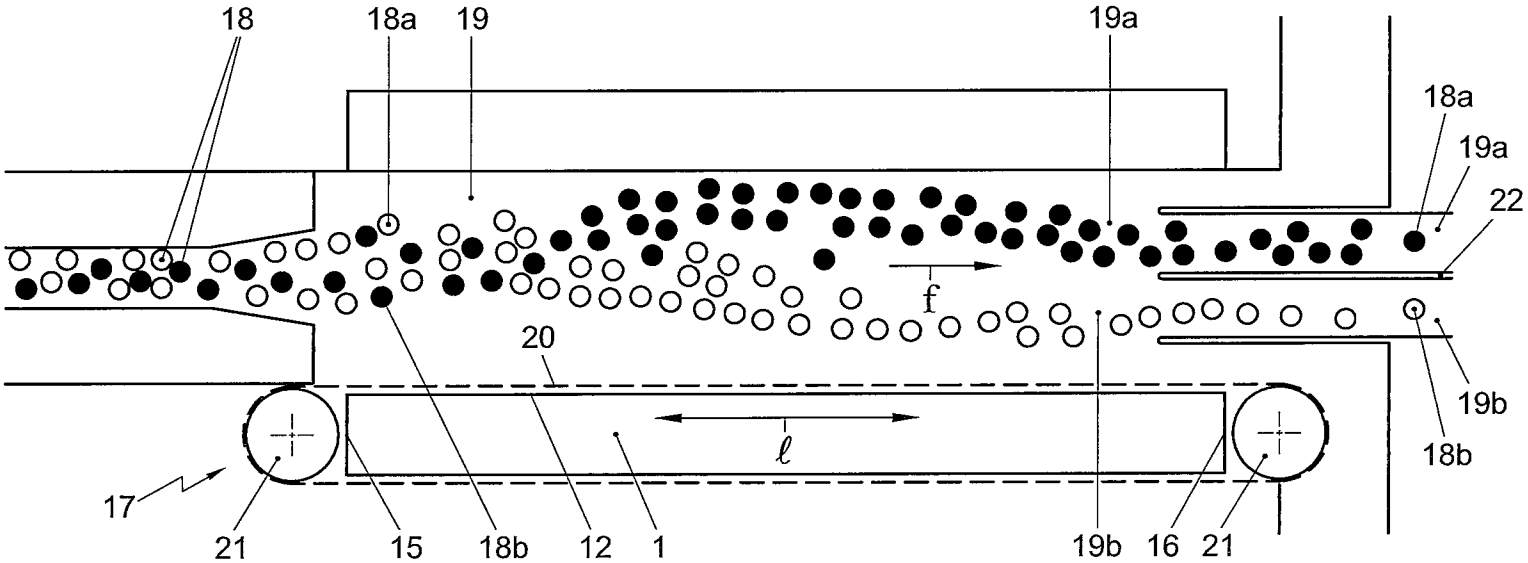
FIG. 3 shows a schematic side view of a magnetic separation device including the magnet of FIG. 1.

FIG. 3 shows a magnetic density separation device 17, including a planar magnet 1 of the type discussed above. In this example, the magnet may have a surface area of 4 $m^2$. Material to be separated, e.g. a mix of scrapped bottles 18 made of a lighter and a heavier plastic material, is fed in a preferably laminar flow of magnetic liquid, in this example ferrofluid, through a channel 19 of the separation device 17 in a flow direction f. A wall 20 of the channel includes the planar magnet 1 arranged with its longitudinal direction aligned with the flow direction. The magnet 1 applies a cut density to the magnetic liquid flowing through the channel 19. The cut density causes the bottles 18*a* made of the lighter plastic to flow in an upper portion of the channel 19, and the bottles 18*b* made of the heavier plastic flow to a lower portion 19 of the channel. The surface 12 of the magnet 1 is covered by a portion of an endless conveyor belt 20 circulating between diverting wheels 21, so that debris is conveyed away from the surface 12 of the magnet 1. Downstream of the magnet 1 a dividing wall 22 is positioned in the channel 19 that splits the channel 19 in a top portion 19*a* for the bottles 18*a* made of material of lower density, and a bottom portion 19*b* for the bottles 18*b* made of material of higher density.

The invention is not limited to the exemplary embodiment represented here. For example, successive pole pieces in longitudinal direction may be embodied as magnets, e.g. electro-magnets, and may have alternating polarity. Such variations shall be clear to the skilled person and are considered to fall within the scope of the invention as defined in the following claims.

REFERENCE NUMERALS

1 Magnet
2 Pole piece, magnet
3 Pole piece, magnetisable
4 Mounting plane
5 Support plate
6 Body
7 Cross section
8 Top segment
9 Top surface
10 Gap
11 Resin
12 Surface
13 Base portion
14 Top portion
15 Leading end
16 Trailing end
17 Separation device
18 Bottles (a lower density, b higher density)
19 Channel (a top, b bottom)
20 Conveyor belt
21 Diverting wheels
22 Dividing wall (a top, b bottom)
f Flow direction
l Longitudinal direction
t Transverse direction
h Height
x Width
l Length

The invention claimed is:

1. A planar magnet for magnetic density separation, comprising:

an array of pole pieces succeeding in longitudinal direction of a mounting plane, each pole piece having a body extending transversely along the mounting plane with a substantially constant cross section, wherein each pole piece includes a top segment with a top surface that is curved to distribute a magnetic field associated with the top surface such that its strength transverse to the mounting plane is substantially uniformly distributed in planes parallel to the mounting plane, and wherein leading and/or trailing pole pieces at respective leading end and/or trailing end of the magnet are of a width that is smaller than the width of any of the pole pieces interposed between the leading and trailing pole pieces, but that is larger than half the width of any of the pole pieces interposed between the leading and trailing pole pieces.

2. The magnet of claim 1, wherein the mounting plane is a support plate onto which the pole pieces are mounted.

3. The magnet of claim 1, wherein the pole pieces extend parallel in a transverse direction of the mounting plane.

4. The magnet of claim 1, wherein the successive pole pieces are spaced apart in a longitudinal direction of the mounting plane.

5. The magnet of claim 1, wherein in a longitudinal direction of the mounting plane the pole pieces are alternatingly embodied as magnetic pole pieces and magnetisable pole pieces.

6. The magnet of claim 5, wherein the successive pole pieces that are embodied as magnetic poles are of the same polarity.

7. The magnet according to claim 1, wherein the pole pieces include a magnetic base portion and a top portion of magnetisable material that includes the curved top segment.

8. The magnet according to claim 1, wherein the curvature of the top segments of the pole pieces is represented by the formula:

$$z = \frac{p}{\pi}\ln\sin\left(\frac{\pi x}{p}\right),$$

wherein 0<x<p, "z" being a height of points at the top surface with respect to a fixed reference point of the top surface, as a function of a horizontal coordinate "x", running along the cross-section of the magnet, and "p" being an interval in "x" over which the profile is periodic.

9. A magnetic density separation device, including a channel for flowing magnetic liquid there through in a flow direction, and a wall of the channel including a planar magnet in accordance to claim 1 arranged with its longitudinal direction aligned with the flow direction so as to apply a cut density to the magnetic liquid flowing through the channel.

10. The magnetic density separation device according to claim 9, wherein a surface of the magnet is covered by a portion of an endless conveyor belt circulating between diverting wheels.

11. The magnetic density separation device according to claim 10, wherein downstream of the magnet a dividing wall is positioned in the channel that splits the channel.

12. The magnet according to claim 1, wherein the curved top segments of the pole pieces in the array are provided with the same basic curvature.

* * * * *